US008161923B2

(12) United States Patent
Watanabe et al.

(10) Patent No.: US 8,161,923 B2
(45) Date of Patent: Apr. 24, 2012

(54) LINK TYPE VARIABLE STROKE ENGINE

(75) Inventors: Sei Watanabe, Wako (JP); Yoshikazu Yamada, Wako (JP); Shohei Kono, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 441 days.

(21) Appl. No.: 12/468,458

(22) Filed: May 19, 2009

(65) Prior Publication Data

US 2009/0288642 A1 Nov. 26, 2009

(30) Foreign Application Priority Data

May 20, 2008 (JP) ..... 2008-131839

(51) Int. Cl.
*F02B 75/04* (2006.01)

(52) U.S. Cl. ..... 123/48 B; 123/48 R; 123/78 BA; 123/78 B

(58) Field of Classification Search ..... 123/48 A, 123/48 AA, 48 B, 48 R, 78 A, 78 B
See application file for complete search history.

(56) References Cited

U.S. PATENT DOCUMENTS

| | | | | |
|---|---|---|---|---|
| 4,422,414 | A * | 12/1983 | Moeller | 123/48 B |
| 4,517,931 | A * | 5/1985 | Nelson | 123/48 B |
| 6,167,851 | B1 * | 1/2001 | Bowling | 123/48 B |
| 6,510,821 | B2 * | 1/2003 | Fujimoto et al. | 123/48 B |
| 6,820,586 | B2 * | 11/2004 | Watanabe | 123/197.1 |
| 7,007,638 | B2 * | 3/2006 | Yamada | 123/48 B |
| 7,185,615 | B2 * | 3/2007 | Sato et al. | 123/48 B |
| 2002/0020368 | A1 * | 2/2002 | Fujimoto et al. | 123/48 B |
| 2002/0020369 | A1 * | 2/2002 | Uneta | 123/73 B |
| 2002/0043228 | A1 * | 4/2002 | Moteki | 123/78 E |
| 2003/0230257 | A1 | 12/2003 | Watanabe | |
| 2004/0003785 | A1 * | 1/2004 | Shimizu et al. | 123/78 E |

(Continued)

FOREIGN PATENT DOCUMENTS

EP 1347159 A2 9/2003

(Continued)

OTHER PUBLICATIONS

European Search Report dated Sep. 14, 2009, issued in corresponding European Patent Application No. 09160110.

(Continued)

*Primary Examiner* — Noah Kamen
*Assistant Examiner* — Long T Tran
(74) *Attorney, Agent, or Firm* — Westerman, Hattori, Daniels & Adrian, LLP

(57) ABSTRACT

In a link type variable stroke engine in which: a crankshaft and a rotary shaft having an eccentric shaft are each rotatably supported on a case main body formed integrally with a cylinder block and opened at one side to form a part of a crankcase, and a support plate fastened to an opened end of the case main body at a plurality of positions; and a piston, the crankshaft and the eccentric shaft are linked by a linking mechanism, in a projection view on a plane orthogonal to axes of the crankshaft and the rotary shaft, two of the plurality of fastening positions at which the support plate is fastened to the opened end of the case main body are disposed on a straight line passing the axes of the rotary shaft and the crankshaft. This configuration can increase the rigidity between the crankshaft and the rotary shaft enough to prevent change of the distance between the crankshaft and the rotary shaft.

3 Claims, 5 Drawing Sheets

U.S. PATENT DOCUMENTS

| | | | | |
|---|---|---|---|---|
| 2004/0011307 | A1 | 1/2004 | Sato et al. | |
| 2005/0016488 | A1* | 1/2005 | Kawakubo et al. | 123/192.2 |
| 2005/0061270 | A1* | 3/2005 | Yamada | 123/78 E |
| 2006/0081211 | A1* | 4/2006 | Genter | 123/197.3 |
| 2006/0144354 | A1 | 7/2006 | Tanaka et al. | |

FOREIGN PATENT DOCUMENTS

| | | | |
|---|---|---|---|
| EP | 1347160 | A2 | 9/2003 |
| EP | 1359303 | A2 | 11/2003 |
| EP | 1674693 | A2 | 6/2006 |
| JP | 57-32267 | Y2 | 7/1982 |
| JP | 9-228858 | A | 9/1997 |
| JP | 2002-285877 | A | 10/2002 |
| JP | 2003-278567 | A | 10/2003 |
| JP | 2005-054685 | A | 3/2005 |
| JP | 2005-291093 | A | 10/2005 |
| JP | 2005-325814 | A | 11/2005 |

OTHER PUBLICATIONS

Japanese Office Action dated Nov. 22, 2011, issued in corresponding Japanese Patent Application No. 2008-131839.

* cited by examiner

LINK TYPE VARIABLE STROKE ENGINE

BACKGROUND OF THE INVENTION

1. Field of the Invention

The present invention relates to a link type variable stroke engine, and especially relates to a link type variable stroke engine in which a crankshaft and a rotary shaft are each rotatably supported on a case main body and a support plate, the case main body formed integrally with a cylinder block and opened at one side to form a part of a crankcase, the support plate fastened to an opened end of the case main body at a plurality of positions, the rotary shaft having an axis parallel with the crankshaft and being provided with an eccentric shaft at an eccentric position, a piston slidably fitted to the cylinder block, the crankshaft and the eccentric shaft are linked by a linking mechanism, and the linking mechanism includes: a main connecting rod coupled, at one end, with the piston; a sub connecting rod rotatably coupled with a crank pin of the crankshaft and rotatably coupled with the other end of the main connecting rod; and a swing rod rotatably coupled, at one end, with the sub connecting rod at a position displaced from a position coupled with the main connecting rod and rotatably coupled, at the other end, with the eccentric shaft.

2. Description of the Related Art

In conventional reciprocating engines, explosion load is only applied between a cylinder head and a crankshaft. For this reason, such a reciprocating engine does not have any functional problem as long as coupling rigidity and strength between the cylinder head and the crankshaft are secured. Accordingly, as seen in many motorcycle engines and general purpose engines, for a configuration in which a crankcase includes a case main body integrally formed with a cylinder block and opened at one side, and a side cover fastened to the opened end of the case main body, and in which the crankshaft is rotatably supported by the case main body and the side cover, it is not necessary to take into account any directional properties, except for the above, in terms of fastening positions at which the side cover is to be fastened to the case main body. Thus, the fastening positions can be any positions as long as being provided at substantially regular intervals to prevent oil leak from coupled parts of the case main body and the side cover.

Meanwhile, a link type variable stroke engine has already been known by Japanese Utility Model Publication No. 57-32267, Japanese Patent Application Laid-open No. 9-228858, the specification of U.S. Pat. No. 4,517,931, Japanese Patent Application Laid-open No. 2002-285877 and the like. In the link type variable stroke engine, a piston, a crankshaft and an eccentric shaft are linked by a linking mechanism, the eccentric shaft provided to a rotary shaft which is parallel with the crankshaft and to which power reduced at a speed reduction ratio of 1/2 from the crankshaft is transmitted. At the time where explosion load occurs in such a link type variable stroke engine, in addition to the explosion load, internal load (components of force) occurs between mutual links, especially, between the crankshaft and the rotary shaft.

When explosion load occurs in the link type variable stroke engine, the explosion load is applied only between the cylinder head and the crankshaft as described above, and, at the same time, internal load (components of force) occurs between the crankshaft and the rotary shaft. However, none of Japanese Utility Model Publication No. 57-32267, Japanese Patent Application Laid-open No. 9-228858, the specification of U.S. Pat. No. 4,517,931 nor Japanese Patent Application Laid-open No. 2002-285877 discloses any support structure of a linking mechanism capable of handling such internal load.

If the rigidity between the crankshaft and the rotary shaft is insufficient and the distance between the shafts changes due to the internal load (components of force), the following problems (1) to (4) arise.

(1) The geometry of the linking mechanism changes and desired piston movement cannot be obtained, resulting in a compression ratio and an expansion ratio different from designed values. (2) The linking mechanism becomes misaligned due to excessive distortion and partial contact and partial wear occur at bearing portions, consequently increasing friction. (3) In a structure in which a gear mechanism is provided between the crankshaft and the rotary shaft, a backlash becomes smaller, causing friction noise and wear of tooth tips and bottoms. (4) In a structure in which a transmission mechanism using an endless belt or chain is provided between the crankshaft and the rotary shaft, the belt deteriorates, and occurrence of tooth-skipping and chain drive noise increase, when the belt or the chain loosens or has excessive tension.

SUMMARY OF THE INVENTION

The present invention has been made in view of the above-described circumstances. It is an object of the present invention to provide a link type variable stroke engine with sufficiently increased rigidity between a crankshaft and a rotary shaft, thereby preventing the above-described problems (1) to (4).

In order to achieve the object, according to a first feature of the present invention, there is provided a link type variable stroke engine in which a crankshaft and a rotary shaft are each rotatably supported on a case main body and a support plate, the case main body formed integrally with a cylinder block and opened at one side to form a part of a crankcase, the support plate fastened to an opened end of the case main body at a plurality of positions, the rotary shaft having an axis parallel with the crankshaft and being provided with an eccentric shaft at an eccentric position, a piston slidably fitted to the cylinder block, the crankshaft and the eccentric shaft are linked by a linking mechanism, and the linking mechanism includes: a main connecting rod coupled, at one end, with the piston; a sub connecting rod rotatably coupled with a crank pin of the crankshaft and rotatably coupled with the other end of the main connecting rod; and a swing rod rotatably coupled, at one end, with the sub connecting rod at a position displaced from a position coupled with the main connecting rod and rotatably coupled, at the other end, with the eccentric shaft, wherein, in a projection view on a plane orthogonal to an axis of the crankshaft and the axis of the rotary shaft, two of the plurality of fastening positions at which the support plate is fastened to the opened end of the case main body are disposed on a straight line passing the axes of the rotary shaft and the crankshaft.

According to a second feature of the present invention, in addition to the first feature, the support plate is a side cover fastened to the opened end of the case main body so as to close the opened end of the case main body for forming the crankcase in cooperation with the case main body.

According to a third feature of the present invention, in addition to the first feature, a side cover and the support plate are each fastened to the opened end of the case main body, the side cover closing the opened end of the case main body for forming the crankcase in cooperation with the case main body, the support plate disposed inwardly of the side cover.

According to the first to third features of the present invention, two of the multiple fastening positions at which the support plate is fastened to the opened end of the case main body are disposed on the straight line passing the axes of the rotary shaft and the crankshaft in a projection view on a plane orthogonal to the axes of the crankshaft and the rotary shaft. This configuration makes it possible to increase the rigidity between the crankshaft and the rotary shaft enough to be capable of bearing the internal load occurring between the crankshaft and the rotary shaft, and consequently to prevent change of the distance between the shafts.

The above description, other objects, characteristics and advantages of the present invention will be clear from detailed descriptions which will be provided for the preferred embodiments referring to the attached drawings.

BRIEF DESCRIPTION OF THE DRAWINGS

FIG. 1 is a longitudinal cross-sectional side view of an engine and a cross-sectional view taken along a line 1-1 in FIG. 2;

FIG. 2 is a cross-sectional view taken along a line 2-2 in FIG. 1; and FIG. 3 is a cross-sectional view taken along a line 3-3 in FIG. 1.

FIG. 4 is a cross-sectional view corresponding to FIG. 2; and

FIG. 5 is a cross-sectional view taken along a line 5-5 in FIG. 4.

DESCRIPTION OF THE PREFERRED EMBODIMENTS

A first embodiment of the present invention will be explained below based on FIG. 1 to FIG. 3.

Figure 1:
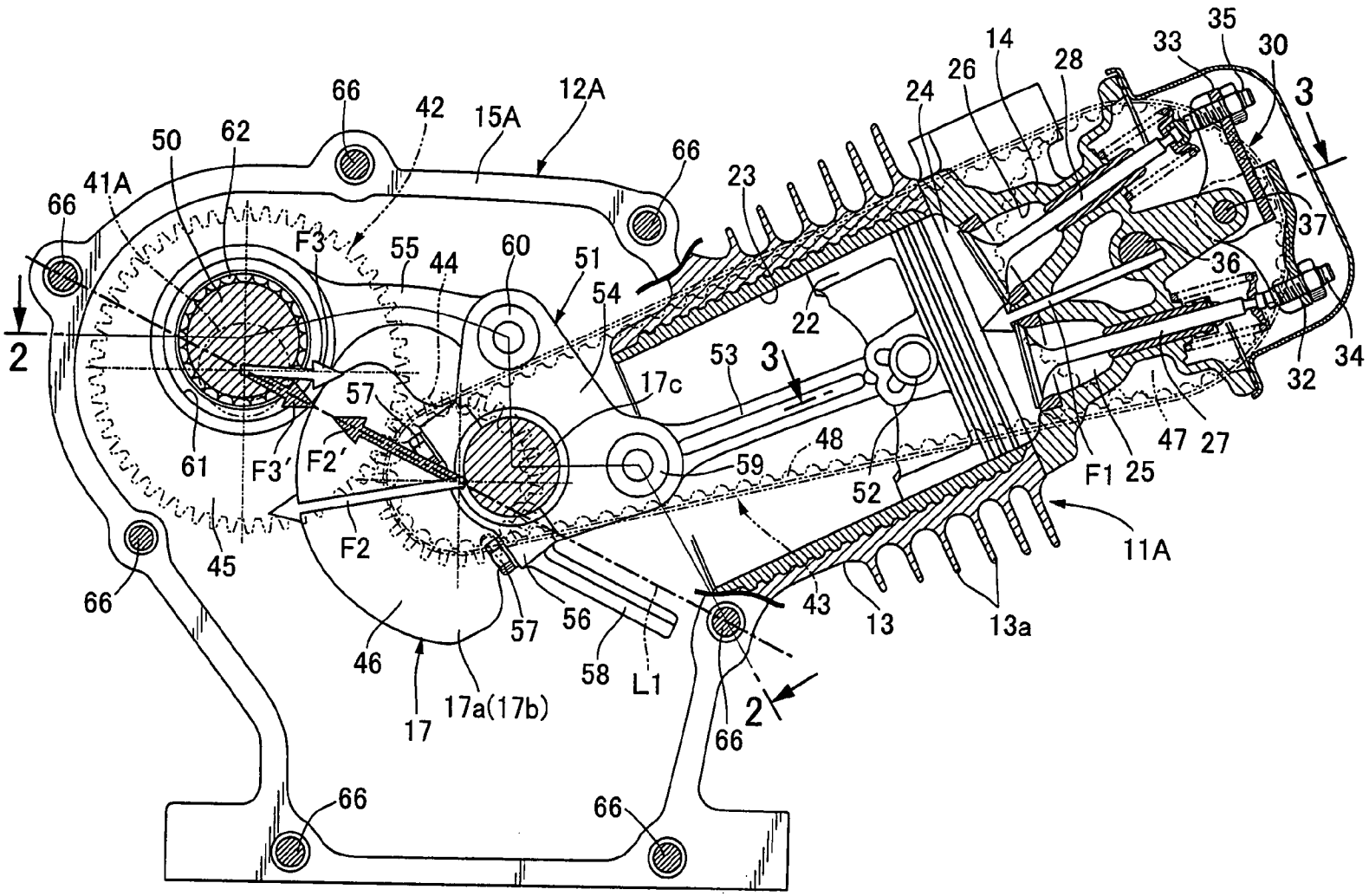
FIG. 1 to FIG. 3 show a first embodiment of the present invention.
Figure 2:
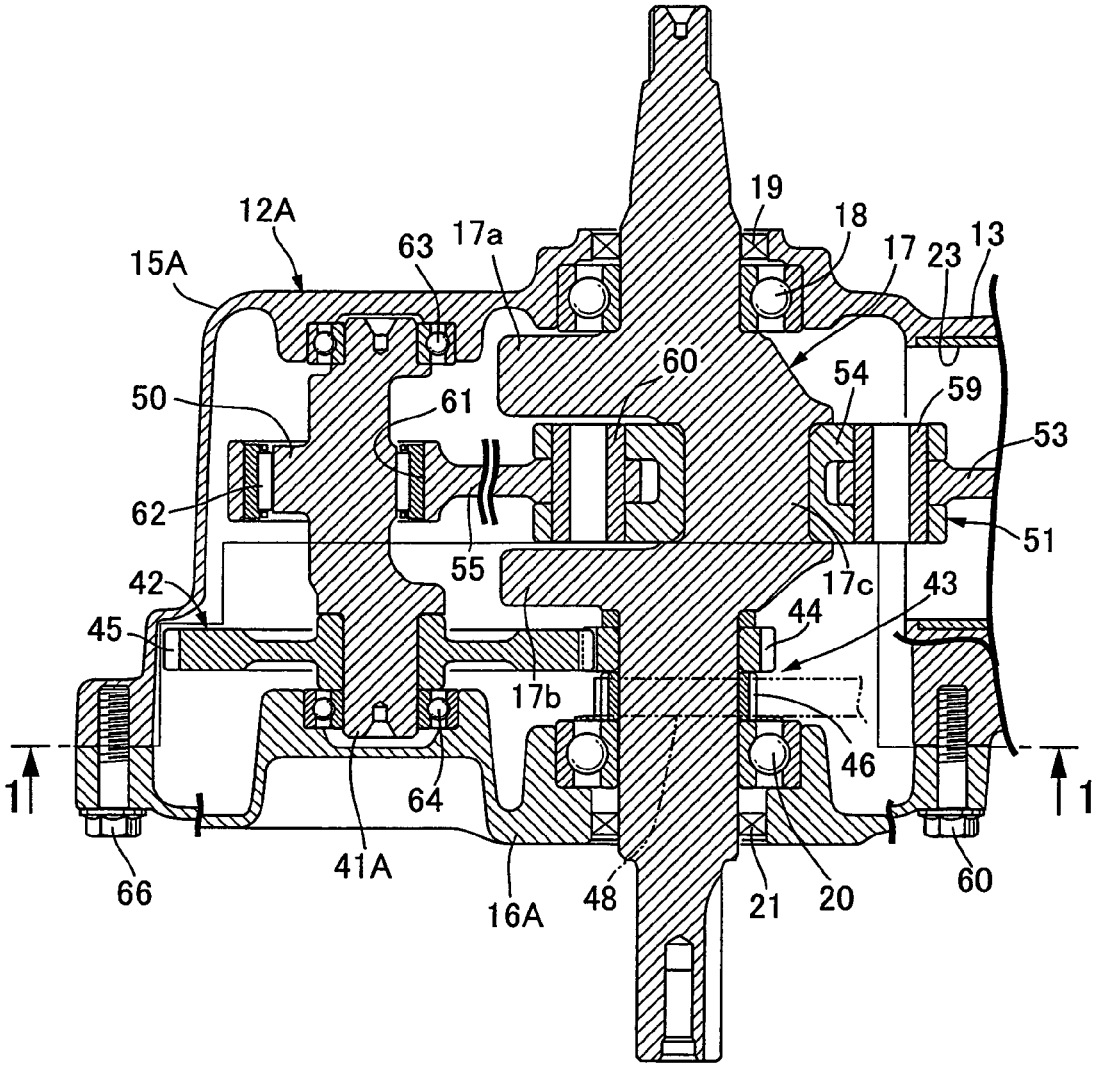

First, in FIG. 1 and FIG. 2, this link type variable stroke engine is an air-cooled single cylinder engine, which is used for working machines and the like, for example. An engine body 11A includes: a crankcase 12A; a cylinder block 13 protruding in upwardly tilting manner from one side surface of the crankcase 12A; and a cylinder head 14 joined to a head portion of the cylinder block 13. A large number of air-cooling fins 13*a* and 14*a* (see FIG. 3) are provided on outer side surfaces of the cylinder block 13 and the cylinder head 14.

The crankcase 12A comprises: a case main body 15A formed integrally with the cylinder block 13 by molding and opened at one side; and a side cover 16A fastened to the opened end of the case main body 15A and served as a support plate. A crankshaft 17 is rotatably supported in the crankcase 12A. The crankshaft 17 integrally has a pair of counterweights 17*a* and 17*b*, as well as a crank pin 17*c* which connects between the counterweights 17*a* and 17*b*. Accordingly, both end portions of the crankshaft 17 rotatably penetrate the case main body 15A and the side cover 16A of the crankcase 12 and protrude outwardly. A ball bearing 18 and an annular sealing member 19 are disposed between the crankshaft 17 and the case main body 15A, the sealing member 19 disposed on the outer side of the ball bearing 18, and a ball bearing 20 and an annular sealing member 21 are disposed between the crankshaft 17 and the side cover 16A, the sealing member 21 disposed on the outer side of the ball bearing 20.

A cylinder bore 23 is formed in the cylinder block 13. A piston 22 is slidably fitted in the cylinder bore 23. A combustion chamber 24 is formed between the cylinder block 13 and the cylinder head 14, and a top portion of the piston 22 faces the combustion chamber 24. An intake port 25 and an exhaust port 26, both communicating with the combustion chamber 24, are formed in the cylinder head 14. In addition, an intake valve 27 for opening and closing the passage between the intake port 25 and the combustion chamber 24 as well as an exhaust valve 28 for opening and closing the passage between the exhaust port 26 and the combustion chamber 24 are disposed in the cylinder head 14 so as to be capable of performing the opening and closing operations.

Figure 3:
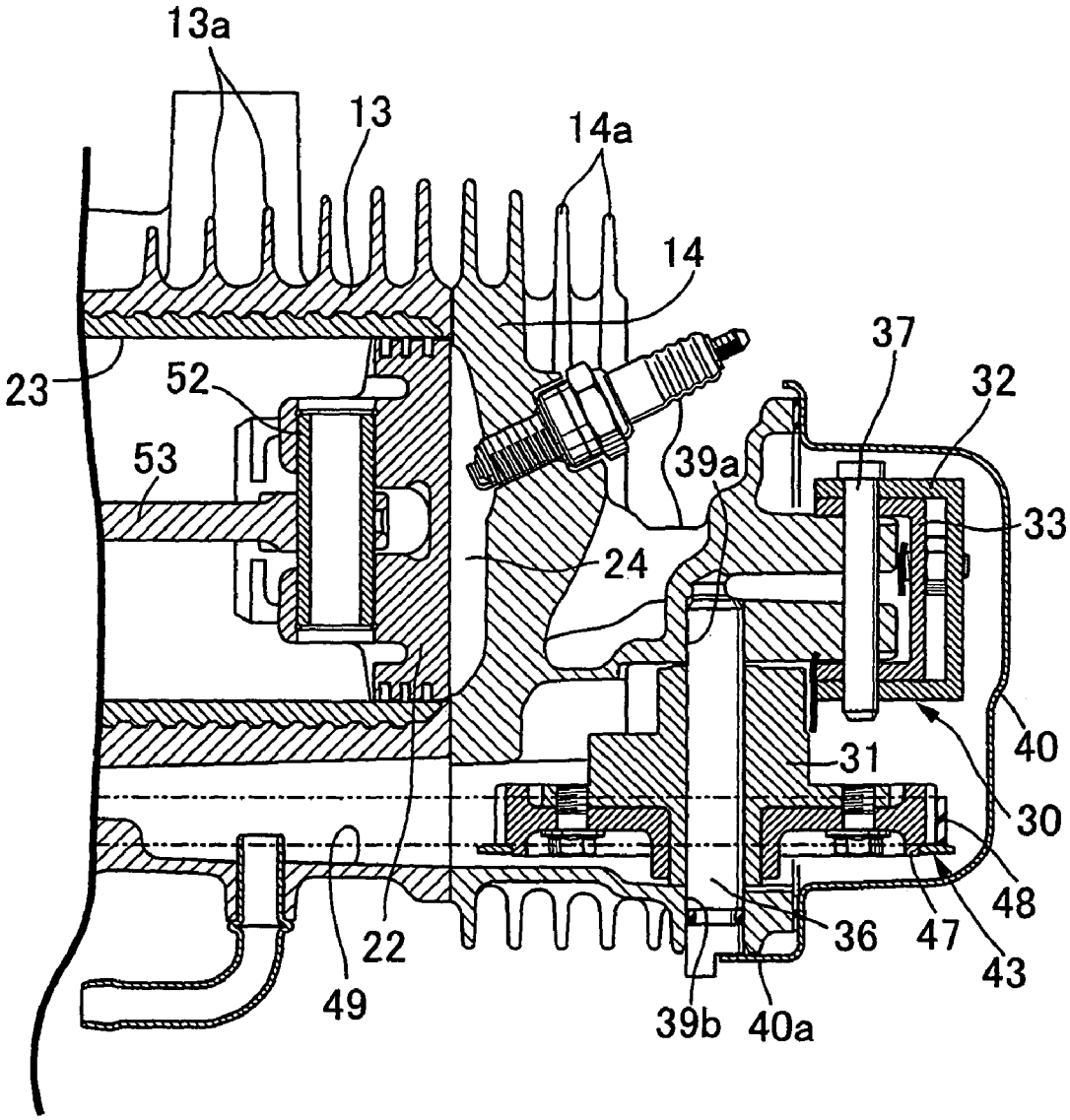

Referring to FIG. 3 in combination, a valve operating mechanism 30 opening and closing the intake valve 27 and the exhaust valve 28 includes: a valve operating cam 31 rotated by the crankshaft 17 at a speed reduction ratio of 1/2; and intake-side and exhaust-side rocker arms 32 and 33 which are each, at one end, in sliding contact with the valve operating cam 31 while tappet screws 34 and 35 are threaded respectively into the other ends of the rocker arms 32 and 33 so that the forward/backward movement positions thereof can be adjusted, the tappet screws 32 and 33 being abutted against upper end portions of the intake valve 27 and the exhaust valve 28, respectively. The valve operating cam 31 is rotatably supported by a first spindle 36 which has an axis parallel with the crankshaft 17 and which is fixedly supported at the cylinder head 14, and the intake-side and exhaust-side rocker arms 32 and 33 are swingably supported by a second spindle 37 which has an axis parallel with the first spindle 36 and which is supported at the cylinder head 14.

In the cylinder head 14, fitting holes 39*a* and 39*b* for the first spindle 36 to be fitted therein are formed with a space therebetween so as to have the same axis, and the fitting hole 39*b* is formed so as to be opened at one side surface of the cylinder head 14. The valve operating mechanism 30 is covered with a head cover 40. The head cover 40 includes an engagement portion 40*a* which is engaged with a protruding end of the first spindle 36 protruding from the fitting hole 39*b*, so as to prevent the first spindle 36 from coming out of the fitting hole 39*b* and rotating about the axis. The head cover 40 is joined to the cylinder head 14.

Opposite end portions of a rotary shaft 41A are rotatably supported at the case main body 15A and the side cover 16A of the crankcase 12 with ball bearings 63 and 64, respectively, the rotary shaft 41A having an axis parallel with the crankshaft 17 while having a rotation axis above a rotation axis of the crankshaft 17. Between the rotary shaft 41A and the crankshaft 17, first timing transmitting means 42 is disposed which reduces the rotation power of the crankshaft 17 at a speed reduction ratio of 1/2 and then transmits the rotation power to the rotary shaft 41A. Further, between the valve operating cam 31 of the valve operating mechanism 30 and the crankshaft 17, second timing transmitting means 43 is disposed which reduces the rotation power of the crankshaft 17 at a speed reduction ratio of 1/2 and then transmits the rotation power to the valve operating cam 31.

The first and second timing transmitting means 42 and 43 are disposed between the side cover 16A and the counterweight 17*b* of the pair of counterweights 17*a* and 17*b* of the crankshaft 17, to be adjacent to each other in an axial direction of the crankshaft 17.

The first timing transmitting means 42 includes: a driving gear 44 fixed to the crankshaft 17; and a driven gear 45 coupled with the rotary shaft 41A so that relative rotation therebetween would not be possible and the driven gear 45 would mesh with the driving gear 44. The second timing transmitting means 43 includes: a driving sprocket 46 provided integrally with the crankshaft 17; a driven sprocket 47 fixedly attached to the valve operating cam 31; and a timing belt 48 wound around the driving sprocket 46 and the driven sprocket 47. In the cylinder block 13 and the cylinder head 14, a timing belt chamber 49 in which the timing belt 48 travels is formed.

An eccentric shaft 50 is provided integrally with the rotary shaft 41A at a position corresponding to a portion between the pair of counterweights 17*a* and 17*b* of the crankshaft 17. The eccentric shaft 50 has its axis at a position eccentric with respect to the axis of the rotary shaft 41A. The eccentric shaft 50, the piston 22 and the crankshaft 17 are linked by a linking mechanism 51.

The linking mechanism 51 comprises: a main connecting rod 53 coupled, at one end, with the piston 22 by using a piston pin 52; a sub connecting rod 54 disposed between the counterweights 17*a* and 17*b* of the crankshaft 17 to be coupled with the crank pin 17*c* and to be rotatably coupled with the other end of the main connecting rod 53; and a swing rod 55 rotatably connected, at one end, with the sub connecting rod 54 at a position displaced from the coupled position of the main connecting rod 53, and rotatably coupled, at the other end, with the eccentric shaft 50.

The sub connecting rod 54 is formed so as to be in sliding contact with half of the circumference of the crank pin 17*c*. A crank cap 56 is disposed to be in sliding contact with the other half of the circumference of the crank pin 17*c*, and is fastened to the sub connecting rod 54 with a plurality of bolts 57 and 57. The crank cap 56 is provided with an oil dipper 58 for dipping up oil stored in the crankcase 12A.

The other end portion of the main connecting rod 53 is rotatably coupled with the one end portion of the sub connecting rod 54 by using a connecting rod pin 59. The one end portion of the swing rod 55 is rotatably coupled with the sub connecting rod 54 by using a swing pin 60. A circular shaft hole 61, which the eccentric shaft 50 penetrates, is formed in the other end portion of the swing rod 55, and a needle bearing 62 is provided between the swing rod 55 and the eccentric shaft 50.

When the rotary shaft 41A is rotated at a speed reduction ratio of 1/2 along with rotation of the crankshaft 17 and the eccentric shaft 50 thereby rotates about the rotation axis of the rotary shaft 41A, the linking mechanism 51 operates, for example, in a manner that the stroke of the piston 22 in the expansion stroke becomes larger than that in the compression stroke. Thus, a higher expansion work is achieved with the same amount of intake of the air-fuel mixture, so that the cycle thermal efficiency can be improved.

In the linking mechanism 51 of the link type variable stroke engine having the above-described configuration, upon occurrence of explosion load F1 applied to the piston 22 as indicated by an arrow in FIG. 1, in a projection view on a plane orthogonal to the axes of the crankshaft 17 and the rotary shaft 41A, as shown in FIG. 1, reaction forces F2 and F3 occur at the crankshaft 17 and the rotary shaft 41A while components of force F2' and F3' of the reaction forces F2 and F3 occur on a straight line L1 passing the axes of the rotary shaft 41A and the crankshaft 17.

Now, the side cover 16A is fastened to the opened end of the case main body 15A at multiple positions, for example, seven positions, by using bolts 66 and 66, to form the crankcase 12A together with the case main body 15A. To prevent change of the distance between the crankshaft 17 and the rotary shaft 41A due to the components of force F2' and F3', two of the multiple fastening positions at which the side cover 16A is fastened to the opened end of the case main body 15A are disposed on the straight line L1 passing the axes of the rotary shaft 41A and the crankshaft 17 in the projection view. In other words, two bolts 66 and 66 of the multiple bolts 66 and 66 are disposed on the straight line L1 on a plane orthogonal to the axes of the rotary shaft 41A and the crankshaft 17.

Next, operations of the first embodiment will be described. Two of the multiple fastening positions at which the side cover 16A is fastened to the opened end of the case main body 15A are disposed on the straight line L1 passing the axes of the rotary shaft 41A and the crankshaft 17 in a projection view on a plane orthogonal to the axes of the crankshaft 17 and the rotary shaft 41A. This configuration can increase the rigidity between the crankshaft 17 and the rotary shaft 41A enough to be capable of bearing the internal load occurring between the crankshaft 17 and the rotary shaft 41A, consequently preventing change of the distance between the crankshaft 17 and the rotary shaft 41A.

Figure 4:
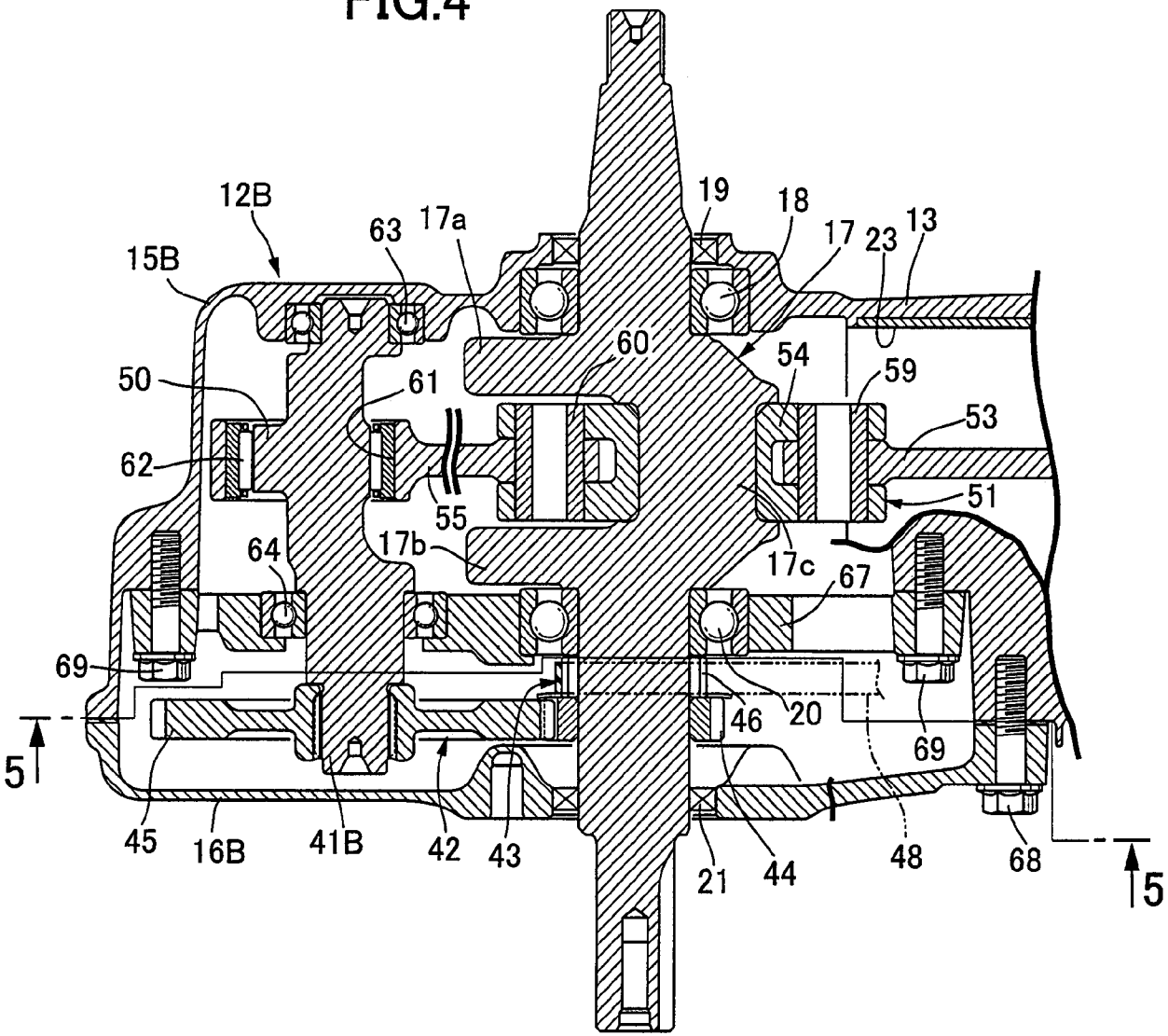
FIG. 4 and FIG. 5 show a second embodiment of the present invention.
Figure 5:
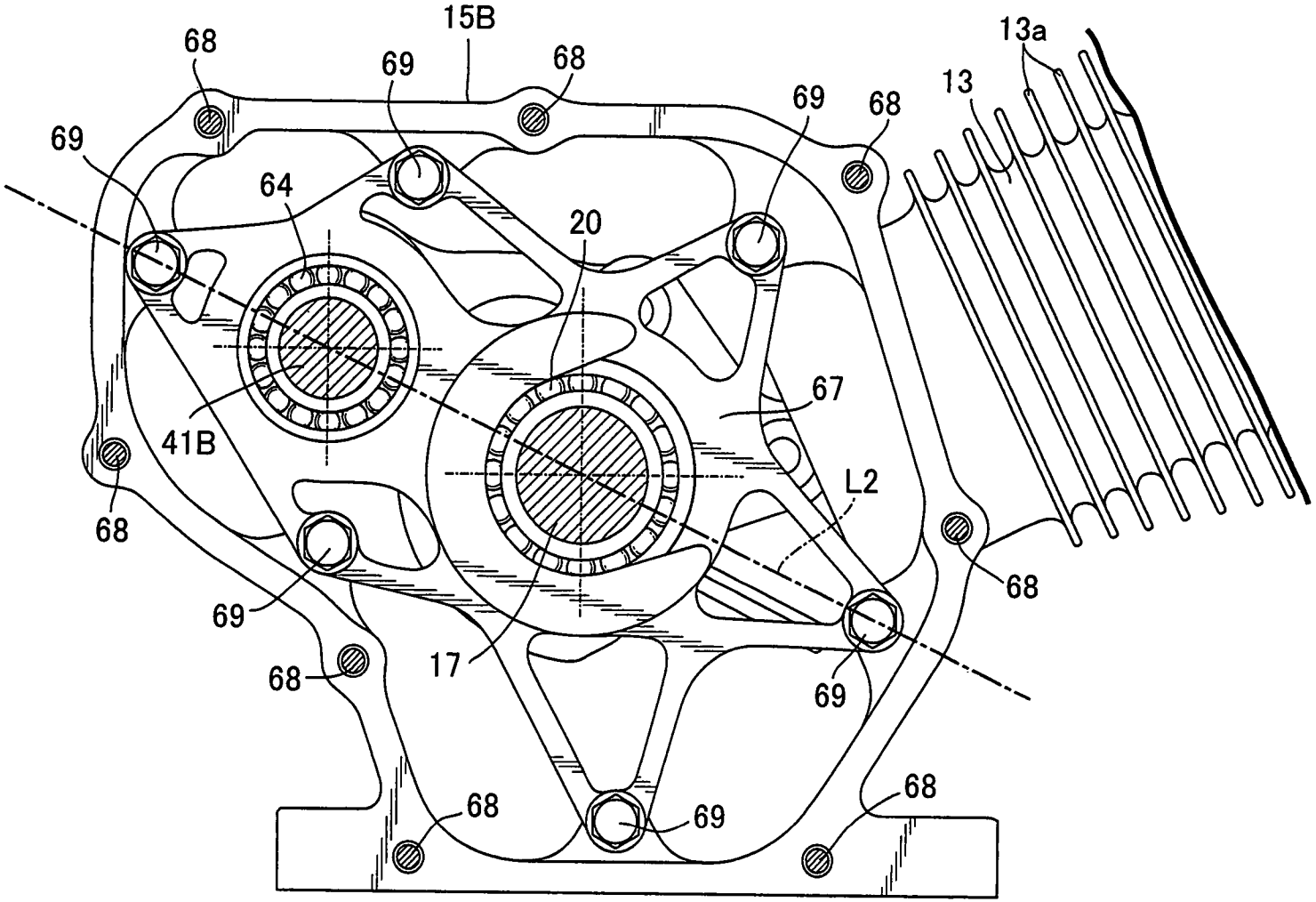

Next, a second embodiment of the present invention will be explained with reference to FIGS. 4 and 5. Here, in the second embodiment, the components corresponding to those of the first embodiment in FIGS. 1 to 3 are simply denoted by the same reference numerals in the drawings and detailed descriptions thereof are omitted.

A crankcase 12B comprises: a case main body 15B formed integrally with a cylinder block 13 by molding and opened at one side; and a side cover 16B fastened to the case main body 15B. The side cover 16B covering the opened end of the case main body 15B and a support plate 67 disposed inside of the side cover 16B are respectively fastened to the opened end of the case main body 15B.

The side cover 16B is fastened to an opened end of the case main body 15B by using multiple, for example, eight, bolts 68 and 68, and the support plate 67 is fastened to the opened end of the case main body 15B by using multiple, for example, six, bolts 69 and 69.

A crankshaft 17 integrally has a pair of counterweights 17*a* and 17*b*, as well as a crank pin 17*c* which connects between the counterweights 17*a* and 17*b*. One end portion of the crankshaft 17 rotatably penetrates the case main body 15B of the crankcase 12B and protrudes outwardly. The other end portion of the crankshaft 17 rotatably penetrates the support plate 67 and the side cover 16B and protrudes outwardly. A ball bearing 18 and an annular sealing member 19 are disposed between the crankshaft 17 and the case main body 15B, the sealing member 19 disposed on the outer side of the ball bearing 18. A ball bearing 20 is disposed between the crankshaft 17 and the support plate 67, and an annular sealing member 21 is disposed between the side cover 16B and the crankshaft 17.

Opposite end portions of a rotary shaft 41B are rotatably supported at the case main body 15B of the crankcase 12B and the support plate 67 with ball bearings 63 and 64, respectively, the rotary shaft 41B having an axis parallel with the crankshaft 17 while having a rotation axis above a rotation axis of the crankshaft 17. Between the rotary shaft 41B and the crankshaft 17 and at a position outward of the counterweight 17*b*, first timing transmitting means 42 is disposed which reduces the rotation power of the crankshaft 17 at a speed reduction ratio of 1/2 and then transmits the rotation power to the rotary shaft 41B. The first timing transmitting means 42 comprises: a driving gear 44 fixed to the crankshaft 17; and a driven gear 45 coupled with the rotary shaft 41B so that relative rotation therebetween would not be possible and the driven gear 45 would mesh with the driving gear 44.

Moreover, a driving sprocket 46 is fixed to a portion of the crankshaft 17, the portion being between the driving gear 44 and the side cover 16B, and a timing belt 48 is looped around the driving sprocket 46. The driving sprocket 46 and the timing belt 48 form a part of second timing transmitting means 43 which reduces the rotation power of the crankshaft 17 at a reduction ratio of 1/2 and then transmits the rotation power to a valve operating mechanism 30 (see the first embodiment) side.

An eccentric shaft 50 is provided integrally with the rotary shaft 41B at a position corresponding to a portion between the pair of counterweights 17*a* and 17*b* of the crankshaft 17. The eccentric shaft 50 has its axis at a position eccentric with respect to the axis of the rotary shaft 41B. The eccentric shaft 50, a piston 22 and the crankshaft 17 are linked by a linking mechanism 51.

In the crankcase 12B, the support plate 67 is disposed so that the first and second timing transmitting means 42 and 43 are interposed between the support plate 67 and the side cover 16B forming a part of the crankcase 12B. The crankshaft 17 and the rotary shaft 41B are rotatably supported at the case main body 15B of the crankcase 12B and the support plate 67 by using the ball bearings 18 and 20 as well as 63 and 64. This configuration can shorten, in each of the crankshaft 17 and the rotary shaft 41B, the distance between a point of load application and each of the corresponding pair of ball bearings 18 and 20 or 63 and 64, which are provided respectively on both sides of the load application point, the point of load application being a point at which load is applied due to explosion load applied to a piston 22 (see the first embodiment). Moreover, the distances can be made approximately equal on the left side and the right side in this embodiment.

Here, the support plate 67 is fastened to the opened end of the case main body 15B by using multiple, for example, six, bolts 69 and 69. To prevent change of the distance between the crankshaft 17 and the rotary shaft 41B due to the components of force caused by application of the explosion load in a direction connecting the axes of the crankshaft 17 and the rotary shaft 41B, two of the multiple fastening positions at which the support plate 67 is fastened to the opened end of the case main body 15B are disposed on a straight line L2 passing the axes of the rotary shaft 41B and the crankshaft 17 in a projection view on a plane orthogonal to the axes of the crankshaft 17 and the rotary shaft 41B. In other words, two bolts 69 and 69 of the multiple bolts 69 and 69 are provided on the straight line L2 on a plane orthogonal to the axes of the rotary shaft 41B and the crankshaft 17.

In this second embodiment, in the same manner of the above-described first embodiment, it is possible to increase the rigidity between the crankshaft 17 and the rotary shaft 41B enough to be capable of bearing the internal load occurring between the crankshaft 17 and the rotary shaft 41B, and consequently to prevent change of the distance between the crankshaft 17 and the rotary shaft 41B.

In addition, since in each of the crankshaft 17 and the rotary shaft 41B, the distance between a point of load application and each of the corresponding pair of ball bearings 18 and 20 or 63 and 64, which are provided respectively on both sides of the load application point, can be shortened, the bending moment at the supporting position of each of the ball bearings 18 and 20 as well as 63 and 64 is suppressed to be small, and the support rigidity can hence be further increased. Moreover, in this embodiment, in each of the crankshaft 17 and the rotary shaft 41B, the distances from the point of load application respectively to the corresponding ball bearings 18 and 20 or 63 and 64, which are provided on the left and right sides of the point of load application, are made approximately equal, the support rigidity on the right side and the support rigidity on the left side can be equal, preventing the crankshaft 17 and the rotary shaft 41B from being displaced in a thrust direction and consequently reducing hitting sound and wear due to thrust.

An embodiment of the present invention is explained above, but the present invention is not limited to the above-mentioned embodiment and may be modified in a variety of ways as long as the modifications do not depart from its gist.

The invention claimed is:

1. A link type variable stroke engine in which a crankshaft and a rotary shaft are each rotatably supported on a case main body and a support plate, the case main body formed integrally with a cylinder block and opened at one side to form a part of a crankcase, the support plate fastened to an opened end of the case main body at a plurality of positions, the rotary shaft having an axis parallel with the crankshaft and being provided with an eccentric shaft at an eccentric position, a piston slidably fitted to the cylinder block, the crankshaft and the eccentric shaft are linked by a linking mechanism, and the linking mechanism includes: a main connecting rod coupled, at one end, with the piston; a sub connecting rod rotatably coupled with a crank pin of the crankshaft and rotatably coupled with the other end of the main connecting rod; and a swing rod rotatably coupled, at one end; with the sub connecting rod at a position displaced from a position coupled with the main connecting rod and rotatably coupled, at the other end, with the eccentric shaft, wherein, in a projection view on a plane orthogonal to an axis of the crankshaft and the axis of the rotary shaft, two of the plurality of fastening positions at which the support plate is fastened to the opened end of the case main body are disposed on a straight line passing the axes of the rotary shaft and the crankshaft.

2. The link type variable stroke engine according to claim 1, wherein the support plate is a side cover fastened to the opened end of the case main body so as to close the opened end of the case main body for forming the crankcase in cooperation with the case main body.

3. The link type variable stroke engine according to claim 1, wherein a side cover and the support plate are each fastened to the opened end of the case main body, the side cover closing the opened end of the case main body for forming the crankcase in cooperation with the case main body, the support plate disposed inwardly of the side cover.

* * * * *